United States Patent [19]

Benjamin

[11] 4,178,895

[45] * Dec. 18, 1979

[54] TWO STAGE VACUUM BREAK ASSEMBLY

[75] Inventor: Benjamin C. Benjamin, Flint, Mich.

[73] Assignee: Schmelzer Corporation, Durand, Mich.

[ * ] Notice: The portion of the term of this patent subsequent to Jul. 4, 1995, has been disclaimed.

[21] Appl. No.: 896,940

[22] Filed: Apr. 17, 1978

[51] Int. Cl.[2] ..... F02M 7/24

[52] U.S. Cl. ..... 123/119 F; 261/39 B

[58] Field of Search ..... 261/39 B; 123/103 R, 123/119 F, 103 B, 103 D, 98 B

[56] References Cited

U.S. PATENT DOCUMENTS

| | | | |
|---|---|---|---|
| 2,695,033 | 11/1954 | Campbell | 123/119 F |
| 3,773,023 | 11/1973 | Taylor | 261/39 B |
| 3,886,241 | 5/1975 | Schubeck | 123/119 F |
| 3,965,223 | 6/1976 | Benjamin | 261/39 B |
| 3,991,731 | 11/1976 | Benjamin | 261/39 B |
| 4,027,634 | 6/1977 | Benjamin | 261/39 B |
| 4,098,459 | 7/1978 | Benjamin | 261/39 B |

FOREIGN PATENT DOCUMENTS

| | | | |
|---|---|---|---|
| 2439441 | 2/1976 | Fed. Rep. of Germany | 261/39 B |

*Primary Examiner*—Charles J. Myhre
*Assistant Examiner*—Carl S. Miller
*Attorney, Agent, or Firm*—Fisher, Gerhardt, Crampton & Groh

[57] ABSTRACT

A fluid motor or vacuum break device for use with the carburetor of an internal combustion engine in which an output plunger of the motor moves in two stages in succession with a period of delay therebetween in response to variable pressure in the form of vacuum from the intake manifold of an engine. Upon admission of vacuum pressure to a variable pressure chamber a diaphragm assembly moves in a first stage after which there is a period of delay and the diaphragm assembly and plunger moves in a second stage together with a movable wall.

14 Claims, 3 Drawing Figures

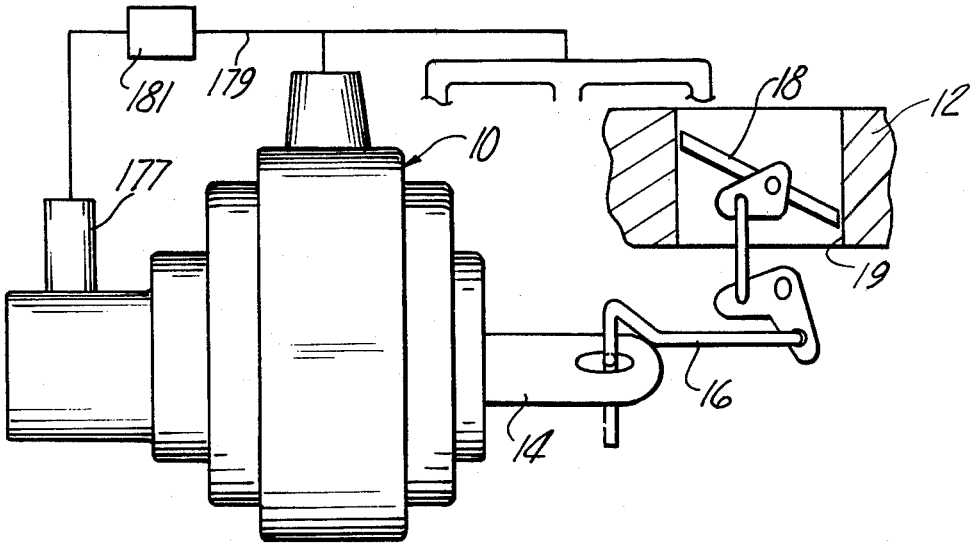
Fig-1
Fig-3
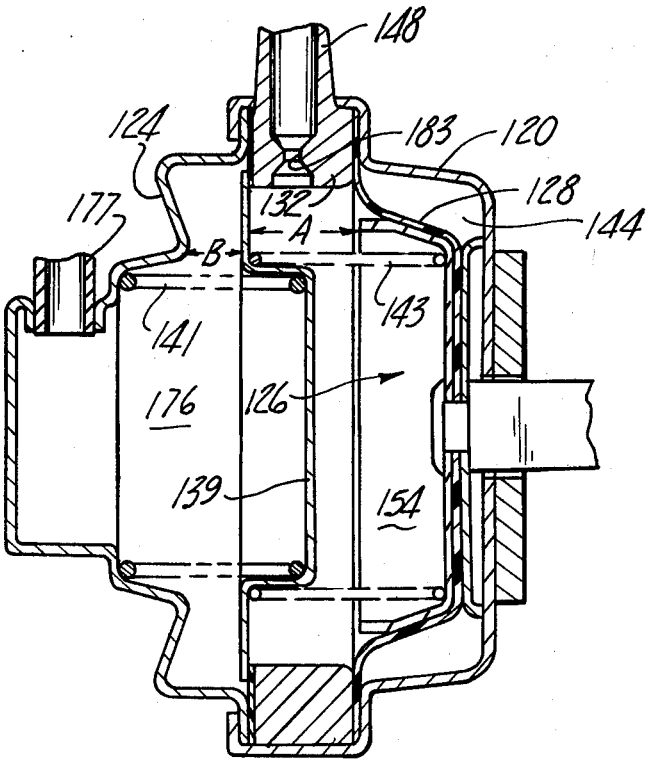

TWO STAGE VACUUM BREAK ASSEMBLY

The present invention relates to vacuum motors and more particularly to vacuum break devices for use with carburetors of internal combustion engines.

In charge forming systems of internal combustion engines, vacuum break devices in the form of a vacuum actuated motors are used to open the choke valve after the engine has started. In many instances at least two such vacuum break devices are used, both of which must be designed for the particular model of engine and model of automobile in which the device is used. This makes it necessary not only to have two vacuum break devices for each vehicle but also to provide the necessary space in the engine compartment for mounting of such vacuum break devices.

It is an object of the invention to provide a single vacuum break device with two stages of operation thereby eliminating the need for a pair of vacuum break devices.

Another object of the invention is to provide a single vacuum break device with two stages of operation which simplifies the linkage connections required between the carburetor and the vacuum break device.

A two stage vacuum break device is provided wherein a housing is connected to a source of variable vacuum pressure such as the intake manifold of an internal combustion engine and a housing contains a single diaphragm assembly which operates in cooperation with a movable wall in the housing. The diaphragm assembly and movable wall serve to divide the housing into a constant pressure chamber, a variable pressure chamber and a delay chamber so that upon establishing a vacuum pressure in the variable pressure chamber the diaphragm assembly moves an output plunger connected to the choke of a carburetor until the diaphragm assembly engages the movable wall. Thereafter, there is a period of delay as variable pressure is established also in the delay chamber after which the diaphragm assembly and movable wall move together as a unit in a second stage of operation to move the choke valve to a further open position.

These and other objects of the invention will be apparent from the following description and from the drawings in which:

FIG. 1 is a diagrammatic view of a vacuum motor or break device shown diagrammatically as being connected to the carburetor and manifold of an internal combustion engine;

FIG. 3 is a view similar to FIG. 2 showing another embodiment of the invention.

Figure 2:
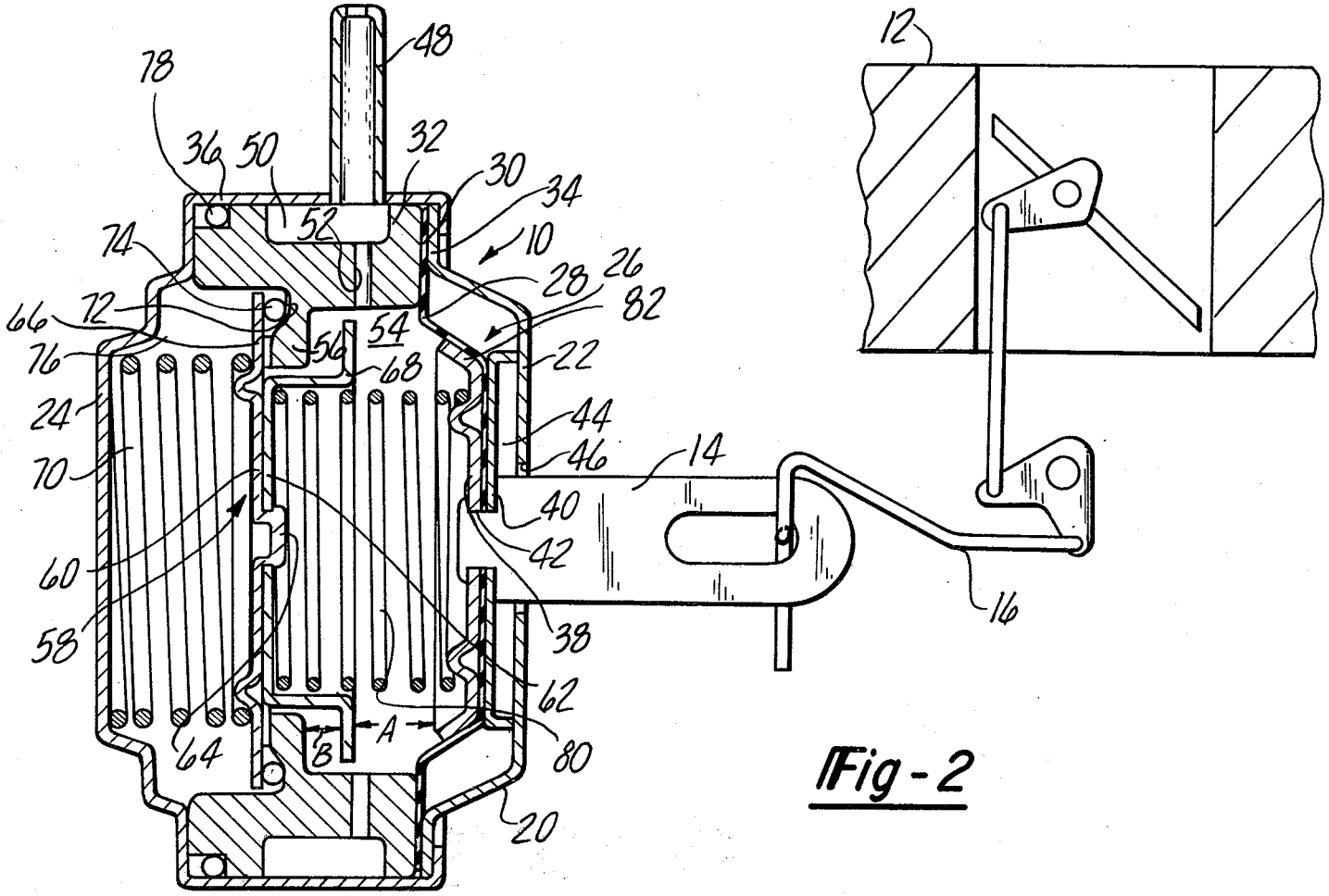
FIG. 2 is a cross sectional elevational view of a vacuum motor.

Referring to FIG. 1, a vacuum break device embodying the invention is designated at 10 and is adapted to be supported relative to a carburetor 12. The vacuum break device 10 has an output 14 connected by a suitable linkage system 16 to a choke valve 18 in the air induction passage 19 of the carburetor 12 to move the choke valve 18 from its illustrated closed position to an open position.

In FIG. 2 the vacuum break 10 has a housing cover 24. Disposed within the housing 20 is a diaphragm assembly 26 which includes a flexible diaphragm 28 made of an elastomeric material and having an outer circumferential flange 30 clamped between an annular body member 32 and a flange 34 of the front cover 22. The flange 36 of the rear cover 24 is folded over the flange 34 to hold the front and rear cover members 22 and 24 and the annular body member 32 in an assembled position.

The diaphragm assembly 26 includes a pair of backing plates 38 and 40 disposed at opposite sides of the diaphragm 28 and held together by the upset end 42 of the plunger 14.

The diaphragm assembly 26 moves the plunger 14 when it is subjected to a pressure differential. For this purpose, a chamber 44 is formed in the housing 20 at one side of the diaphragm assembly 26. This chamber is in continuous communication with the atmosphere through an opening 46 through which the plunger 14 passes. The opposite side of the diaphragm assembly 26 is initially at atmospheric pressure which is changed to sub-atmospheric pressure through a vacuum connection 48 connected to the intake manifold of an internal combustion engine. The vacuum connection 48 communicates with a cavity 50 and passage 52 with a variable pressure chamber 54 formed to the left of the diaphragm 28 as viewed in FIG. 1.

An annular wall 56 is formed integrally with and extends radially inwardly from the annular body 32 and forms a seat for engaging a movable wall assembly 58. The wall 58 is formed of a pair of generally disc shaped mambers 60 and 62 which are joined together by upsetting the disc member 60 relative to the disc 62 as indicated at 64. The radial outer ends of the disc 60 and 62 form a pair of spaced flanges 66 and 68 which are spaced apart from each other and are disposed at opposite sides of the annular wall 56.

The wall assembly 58 is urged to the right as viewed in FIG. 2 so that the flange 66 is urged toward the annular wall 56 by a spring 70 acting between the rear cover 24 and disc 60. The disc 60 is provided with a large O-ring seal 74 which is pressed into sealing engagement with the annular wall 56. Extending radially from opposite sides of the seal 74 when the latter is in engaging relationship with the annular wall 56 is a bleed groove 72 which is formed in the wall 56. The ring 74 bridges across the radially extending groove 72 which remains open continuously. Bleed groove 72 maintains the variable pressure chamber 54 in constant communication with a delay chamber 76 formed in the housing to the left of wall assembly 58. The bleed groove 72 is the means of communicating pressure to the delay chamber 76 which is sealed against the introduction of atmospheric pressure by a ring seal 78 acting between the annular body member 32 and the rear cover 24.

In the normal position of the vacuum break device all of the chambers, that is, the constant pressure chamber 44, the variable pressure chamber 54 and the delay chamber 76 are at atmospheric pressure and the parts occupy the position viewed in FIG. 1 with the choke plate 18 in a closed position and the diaphragm assembly 26 against the front cover 22 and the movable wall 58 against the annular wall 56.

When the internal combustion engine with which the carburetor 12 is associated is started, vacuum pressure developed in the manifold is supplied to the cavity 50 and to the variable pressure chamber 54. Upon decreasing the pressure in the variable pressure chamber 54 a pressure differential is created on the diaphragm assembly 26 causing it to move to the left against the action of a spring 80 which acts between the backing plate 38 and the disc 62 of the wall assembly 58. Such movement of the diaphragm assembly 26 causes the plunger 14 to be moved to the left in a first stage until a lip 82 on the backing plate 38 comes into engagement with the flange 68 on the movable wall assembly 58.

With vacuum pressure established in the variable pressure chamber 54, a differential pressure acts also on the movable wall assembly 58 because of the atmospheric pressure in the delay chamber 76. This causes the wall assembly 58 to be urged into tighter engagement with the annular wall 56. Air from the delay chamber 76 is bled through the radially extending passage or groove 72 and after a delay period, vacuum pressure is established in the chamber 76. This results in movement of the diaphragm assembly 26 and the movable wall 58 as a unit to the left in a second stage of plunger movement under the influence of atmospheric pressure in the constant pressure chamber 44. Such movement continues until the flange 68 on the disc 62 engages the annular wall 56 forming part of the body member 32.

The two stages of movement make it possible to initially open the choke valve 18 a small amount and after a few seconds delay to move the choke to a more fully open position.

Upon subjecting the variable pressure chamber 54 to a vacuum, a differential pressure is created on one side of both the diaphragm assembly 26 and the movable wall 58. During movement of the diaphragm assembly 26 against the action of the spring 80, the movable wall 58 must remain stationary to maintain a seal with the annular wall 56 and to limit movement of the diaphragm assembly 26 in the first stage of movement. This is necessary so that the two stages of movement are distinct from each other and can be separated by a period of delay. The movable wall 58 is maintained in its sealed position by the larger spring 70 as well as the differential pressure acting on the movable wall 56. The area of the movable wall acted on by differential pressure is defined by the O-ring seal 74. This area is slightly larger than the effective area of the diaphragm assembly 26 which also is acted on by differential pressure. As the pressures in the variable pressure chamber 54 and in the delay chamber 76 become equal to each other, the differential pressure acting on the diaphragm assembly 26 becomes effective to move both the diaphragm assembly 26 and the movable wall 58 to overcome the resistance of the spring 70.

The plunger 14 is moved from the left to the right after it has moved through its two stages when the vacuum source is terminated as by turning off the engine. Under that condition atmosphere is re-established in the variable pressure chamber 54 as well as the delay chamber 76. Upon equalization of pressures in the chambers the springs 70 and 80 become effective to move the plunger back to the right to its initial, normal position.

Another embodiment of the vacuum break 10 is seen in FIG. 3 and includes a housing 120 with a front housing cover 122 and rear housing cover 124. A diaphragm assembly 126 includes a flexible diaphragm 128 having its outer circumference clamped between an annular body member 132 and the front cover 122. The flange 136 of the front cover 122 is folded over the rear cover member 124 to clamp the annular body member 132 and the cover members together as well as to hold an annular seal 137 in position.

The diaphragm assembly 126 is connected to the plunger 14 in the same manner as in the embodiment seen in FIG. 2. The housing also contains a movable wall 139 which is urged into sealing engagement with seal 137 by a spring 141 acting between the rear cover 124 and one side of the movable wall 139. Another spring 143 exerting a smaller force than the spring 141 acts between the other side of the movable wall 139 and the diaphragm assembly 126.

The diaphragm assembly 126 and the movable wall 139 divide the housing 120 into a constant pressure chamber 144, a variable pressure chamber 154 and a delay chamber 176.

In this embodiment of the invention the variable pressure chamber 154 communicates with the intake manifold through a vacuum connection 148 and the delay chamber 176 communicates through an inlet tube 177 and a conduit 179 with the intake manifold of the engine. The conduit 179 includes a delay means 181 which may take various forms such as a restricted bleed passage or a temperature responsive valve responding to the temperature of the internal combustion engine after it has started.

This embodiment of the invention operates in substantially the same manner as the embodiment seen in FIG. 2 except that the delay means 181 is formed externally of the housing and communicates the vacuum source and delay chamber through a separate conduit.

As in the embodiment in FIG. 2, the vacuum break shown in FIG. 3 maintains the movable wall 139 in sealing engagement with the seal 136 by means of a spring 141 which is stronger than the spring 143 and by providing the movable wall 139 with a larger effective area than the diaphragm 128. The combination of the stronger spring 141 and the larger force due to pressure maintains the movable wall 139 in position until the diaphragm assembly 126 has completed its first stage of movement which occurs when it engages the movable wall.

In the embodiments of the invention seen in FIGS. 2 and 3, the first stage of movement is designated by the dimension A and the second stage of movement is designated by the dimension B.

Referring again to FIG. 3, the vacuum connection 148 is provided with a restricted portion 183. This restriction is provided so that vacuum is not established in the chamber 154 at such a rapid rate that the diaphragm assembly 126 and stem 14 move so rapidly that the inertia of the parts causes the movable wall 139 to lift from the seal 136. Such separation of the wall 139 and seal 136 would prevent the second stage of operation and delay period from occurring. A similar restriction may be employed in the vacuum connection 48 or the passages 52 of the embodiment seen in FIG. 2.

A vacuum break device has been provided in which a diaphragm assembly and a movable wall are disposed in a housing and divide the latter into a constant pressure chamber, a variable pressure chamber and a delay chamber. Vacuum pressure is made available from a single source to the variable pressure chamber such that upon starting of an internal combustion engine a differential pressure is created causing the diaphragm assembly to move thereby moving a plunger connected to a device to be operated such as the choke valve of a carburetor. The plunger moves in a first stage of operation to partially open the choke valve until it comes into engagement with the movable wall. After a period of delay and as variable pressure also is established in the delay chamber, the diaphragm assembly and movable wall move as a unit in a second stage of operation to move the plunger and to open the choke valve an additional amount.

The embodiments of the invention in which an exclusive property or privilege is claimed are defined as follows:

1. A vacuum motor comprising; a housing, a diaphragm in said housing forming a constant pressure chamber at one side, a movable wall in said housing forming a delay chamber at one side, said diaphragm and said movable wall forming a variable pressure chamber therebetween, a vacuum pressure source, first means communicating said vacuum pressure source with said variable pressure chamber, second means between said vacuum pressure source and said delay chamber, a plunger connected to and movable with said diaphragm, said diaphragm being movable in a first range to engage said movable wall in the presence of variable pressure in said variable pressure chamber, said diaphragm and said wall being movable as a unit in a second range upon establishing vacuum pressure in said delay chamber, and means delaying establishing vacuum pressure in said delay chamber until after vacuum pressure is established in said variable pressure chamber.

2. The combination of claim 1 wherein said first and second means communicate separately with said variable pressure and delay chambers, respectively, and said delaying means is associated with said second means.

3. The combination of claim 2 in which said delaying means comprises a passage restricting air flow.

4. The combination of claim 2 in which said delaying means is responsive to temperature.

5. The combination of claim 3 wherein said passage restricting air flow is disposed in said housing.

6. The combination of claim 1 wherein said delaying means includes an open groove formed in said housing covered by said movable wall when said plunger is moving in said first range.

7. The combination of claim 6 wherein said groove extends radially, and an annular seal supported on said movable wall and movable therewith, said annular seal engaging said annular wall to permit restricted communication to said delay chamber, said seal being movable with said movable wall to fully open said delay and variable pressure chamber to each other.

8. The combination of claim 1 wherein said variable pressure and delay chambers are in full communication with each other during unitary movement in said second stage of movement.

9. The combination of claim 1 and further comprising means biasing said diaphragm to an initial position with a first force and additional means biasing said movable wall into its initial position with a second force greater than said first force.

10. The combination of claim 1 wherein said movable wall is in sealing engagement with a portion of said housing to define an effective area subject to differential pressure greater than the effective area of said diaphragm.

11. The combination of claim 1 wherein said constant pressure chamber is subjected to atmospheric pressure and wherein said variable pressure chamber is under the influence of pressure varying from atmospheric pressure to vacuum pressure and said delay chamber has pressure varying from atmospheric to vacuum pressure.

12. In combination, a vacuum responsive device, a choke valve, and an internal combustion engine, said engine including a carburetor and an intake manifold, said carburetor including an induction passage, said choke valve in said passage, said vacuum responsive device being operatively connected to move said choke valve initially from a closed position to a partly open position in response to a predetermined vacuum in the engine intake manifold when the engine is started and subsequently after a period of delay to move said choke valve from said partially open position to a fully open position, said vacuum responsive device including a housing, a diaphragm in said housing forming a constant pressure chamber at one side, a movable wall in said housing forming a delay chamber at one side, said diaphragm and said movable wall forming a variable pressure chamber therebetween, means communicating said manifold with said variable pressure chamber, passage means between said manifold and said delay chamber, a plunger connected to said choke valve and to said diaphragm, said diaphragm being movable in a first range upon starting of said engine to establish vacuum pressure in said variable pressure chamber to engage said movable wall, said diaphragm and wall being movable as a unit in a second stage upon establishing vacuum pressure in said delay chamber through said passage means.

13. The combination of claim 12 wherein said passage means includes delay means preventing establishment of vacuum pressure in said delay chamber until the establishment of such pressure in said variable pressure chamber.

14. The combination of claim 13 wherein said delay means is responsive to temperature of said internal combustion engine to open said passage means after establishment of vacuum pressure in said variable pressure chamber.

* * * * *